US006665968B2

(12) United States Patent
Jen

(10) Patent No.: US 6,665,968 B2
(45) Date of Patent: Dec. 23, 2003

(54) POLE WITH LIFTING MOUNT AND BANNER DISPLAY

(75) Inventor: Chung-Hua Jen, Decatur, GA (US)

(73) Assignee: Videolarm, Inc., Decatur, GA (US)

( * ) Notice: Subject to any disclaimer, the term of this patent is extended or adjusted under 35 U.S.C. 154(b) by 0 days.

(21) Appl. No.: 10/256,725

(22) Filed: Sep. 27, 2002

(65) Prior Publication Data

US 2003/0024144 A1 Feb. 6, 2003

Related U.S. Application Data

(63) Continuation of application No. PCT/US01/10618, filed on Apr. 3, 2001, which is a continuation of application No. 09/566,350, filed on May 8, 2000, now Pat. No. 6,447,150

(60) Provisional application No. 60/194,919, filed on Apr. 4, 2000.

(51) Int. Cl.[7] ..... G09F 7/20; G09F 17/00

(52) U.S. Cl. ..... 40/601; 40/604; 52/736.1; 248/125.2; 248/295.11

(58) Field of Search ..... 40/601, 603, 604, 40/606, 607; 248/125.1, 125.2, 295.11; 52/732.1, 736.1

(56) References Cited

U.S. PATENT DOCUMENTS

| | | | | |
|---|---|---|---|---|
| 1,006,834 | A | * 10/1911 | Edwards | 248/125.2 |
| 1,284,909 | A | * 11/1918 | La Rose et al. | 40/607 |
| 2,584,713 | A | * 2/1952 | Kanaval | 40/606 |
| 2,738,492 | A | 3/1956 | Arneson et al. | |
| 2,908,408 | A | 10/1959 | Reed | |
| 3,288,412 | A | * 11/1966 | Murphy | 248/125.2 |
| 3,310,899 | A | * 3/1967 | Hart et al. | 40/604 |
| 3,579,880 | A | * 5/1971 | Murphy | 40/601 |
| 3,610,584 | A | 10/1971 | Pfaff | |
| 3,822,051 | A | 7/1974 | Karapita | |
| 3,862,734 | A | * 1/1975 | Buchin et al. | 248/125.2 |
| 4,025,782 | A | 5/1977 | Kaeser | |
| 4,051,525 | A | 9/1977 | Kelly | |
| 4,173,268 | A | 11/1979 | Nussbaum | |
| 4,198,022 | A | 4/1980 | Pletcher et al. | |
| 4,537,083 | A | 8/1985 | Saringer | |
| 4,593,883 | A | 6/1986 | Nelson | |
| 4,618,886 | A | 10/1986 | Mooney | |
| 4,656,569 | A | 4/1987 | Buskell | |
| 4,974,134 | A | 11/1990 | Bourne | |
| D314,501 | S | 2/1991 | Pagano | |
| 5,224,675 | A | 7/1993 | Ellenberger et al. | |
| 5,255,882 | A | 10/1993 | Schroppel | |
| 5,349,878 | A | 9/1994 | White et al. | |
| 5,398,026 | A | 3/1995 | Handsaker | |
| 5,406,327 | A | 4/1995 | Guarnotta | |
| 5,550,727 | A | 8/1996 | Fenyvesy | |
| 5,887,841 | A | 3/1999 | Newberg | |
| 5,975,726 | A | 11/1999 | Latimer | |
| 6,155,018 | A | * 12/2000 | Yang | 52/736.1 |
| 6,447,150 | B1 | 9/2002 | Jen et al. | |

FOREIGN PATENT DOCUMENTS

| | | |
|---|---|---|
| DE | 31 01 202 A1 | 11/1982 |
| FR | 2 752 805 | 6/1998 |
| WO | WO 94/16267 | 7/1994 |

* cited by examiner

*Primary Examiner*—Alan Cariaso
(74) *Attorney, Agent, or Firm*—Gardner Groff, P.C.

(57) ABSTRACT

A support pole for raising and lowering a supported object between a lower position and an elevated position is disclosed. The support pole includes an elongate pole and a carriage mounted for translational movement up and down the pole. Carriage locks at the top of the pole engage the carriage in the elevated position to prevent vibration of the supported object, and a stabilizer frame within the channel minimizes vibration during carriage transport.

30 Claims, 17 Drawing Sheets

Remote Control Panel

POLE WITH LIFTING MOUNT AND BANNER DISPLAY

CROSS-REFERENCE TO RELATED APPLICATION

This application is a continuation of International Application No. PCT/US01/10618, designating the U.S. and having an international filing date of Apr. 3, 2001; which is a con't of U.S. patent application Ser. No. 09/566,350, filed May 8, 2000, now U.S. Pat. No. 6,447,150; which in turn claimed the benefit of U.S. Provisional patent application Ser. No. 60/194,919, filed Apr. 4, 2000. All said applications are hereby incorporated by reference in their entireties herein.

BACKGROUND OF THE INVENTION

1. Field of the Invention

The present invention relates generally to elevated support structures, and more particularly to a support pole for raising and lowering an object between an elevated position and a lower position.

2. Description of Related Art

It is often desirable to support an object in an elevated position. For example, surveillance cameras, lights, signs, flags, banners, antennas and weather monitoring equipment are often supported a distance above the ground by mounting on a pole or mast. The added height can provide considerable advantage, including improved visibility, a better vantage point, improved signal reception, and avoidance of interference by lower structures and objects. However, maintenance, repair and installation of elevated equipment is often difficult and expensive, and may expose personnel to additional risk of injury due to the possibility of falls. Often, special equipment such as ladders, scaffolding or bucket trucks are required for access to elevated equipment.

Efforts have been made to facilitate service of elevated equipment at ground level by providing masts having equipment that can be raised and lowered. For example, U.S. Pat. No. 4,051,525 to Kelly, and U.S. Pat. No. 5,975,726 to Latimer disclose poles having cable lift mechanisms for raising and lowering equipment. Previously known poles facilitating the raising and lowering of equipment, however, have not proven fully satisfactory for a variety of reasons. For example, the lift mechanisms of such poles are often quite complex and include a substantial number of moving parts, rendering them expensive to produce and maintain. In addition, many such mechanisms incorporate external working parts such as pulleys and cables, which are exposed to damage from the elements, present a risk of injury to persons coming into contact with moving parts, and detract considerably from the external aesthetic appeal of the overall device. Also, the lift mechanisms of many such poles require specialized tools and equipment to operate and service, and often require a dedicated power source to drive the lift mechanism, adding further to the expense and complexity of the device.

Accordingly, it has been found that a need exists for an improved pole having a lifting mount for raising and lowering equipment between an elevated position and a lower position. It is to the provision of a pole and lifting device meeting these and other needs that the present invention is primarily directed.

SUMMARY OF THE INVENTION

The present invention provides an improved pole for supporting equipment such as surveillance cameras, lights, flags, signs, antennas and weather monitoring equipment in an elevated position a distance above the ground or some other base surface. The pole includes a lifting mechanism for raising and lowering the equipment between the elevated position and a lower position. In preferred embodiments described in greater detail herein, the pole of the present invention provides a relatively economical and aesthetically appealing device that is readily operable and easily serviced.

In one aspect, the present invention is a support pole for supporting an object in an elevated position. The support pole preferably includes an elongate pole having a top and a bottom, and a channel extending at least partly between the top and the bottom. The support pole preferably also includes a threaded rod rotationally mounted within the channel, the rod comprising a detachable coupling for engaging a drive tool. The support pole preferably also includes a carriage in engagement with the threaded rod, whereby rotation of the rod imparts translational movement upon the carriage through the channel.

In another aspect, the present invention is a support pole for raising and lowering a supported object between a lower position and an elevated position. The support pole preferably includes an elongate pole having a top and a bottom, and a channel extending at least partly between the top and the bottom. The support pole preferably also includes a carriage translationally mounted within the channel. The support pole preferably also includes a drive mechanism for imparting translational movement of the carriage along the channel, wherein the drive mechanism is substantially housed within the elongate pole.

In another aspect, the present invention is a support pole for raising and lowering a supported object between a lower position and an elevated position. The support pole preferably includes an elongate pole having a top, a bottom, and a channel extending at least partly between the top and the bottom. The support pole preferably also includes a threaded rod rotationally mounted within the channel, the rod comprising a detachable coupling for engaging a drive tool. The support pole preferably also includes a carriage in engagement with the threaded rod, whereby rotation of the rod imparts translational movement upon the carriage through the channel, the carriage comprising a mounting bracket for attachment of the supported object. The support pole preferably also includes a cable having a first end for connection to the supported object, and a second end comprising a detachable coupling. The support pole preferably also includes a pulley carrying the cable, and a return spring connected to the second end of the cable.

These and other objects, features and advantages of preferred forms of the present invention are described in greater detail herein with reference to preferred and example embodiments.

DETAILED DESCRIPTION

Figure 1A:
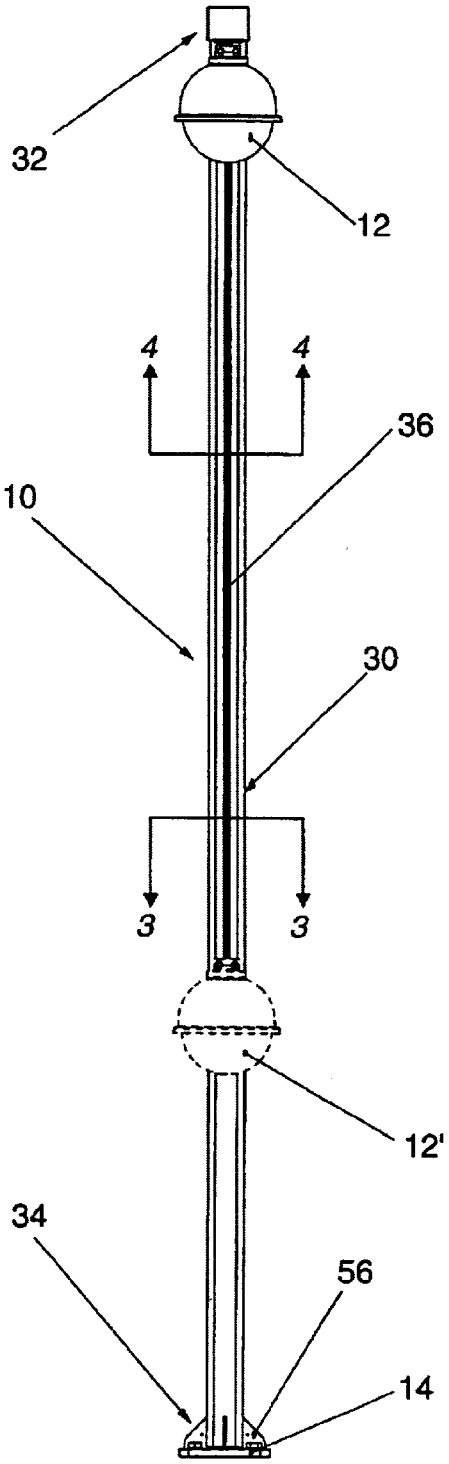
FIGS. 1*a* and 1*b* show front and side views, respectively, of a pole according to a preferred form of the present invention, supporting a surveillance camera housing in an elevated position, and in broken lines showing a surveillance camera housing in a lowered position.

Referring now to the drawing figures, wherein like reference numerals represent like parts throughout, preferred forms of the present invention will now be described. As seen with reference to FIGS. 1–2, the present invention is a support pole 10 for raising and lowering one or more supported objects 12, such as a surveillance camera, a light, a flag, a banner, a sign, an antenna, or weather monitoring equipment. The pole supports the object 12 in an elevated position, shown in solid lines in FIGS. 1*a* and 1*b*, and permits the object to be lowered to a lower position, shown in broken lines as element 12', for maintenance, installation, service, etc.

Figure 1B:
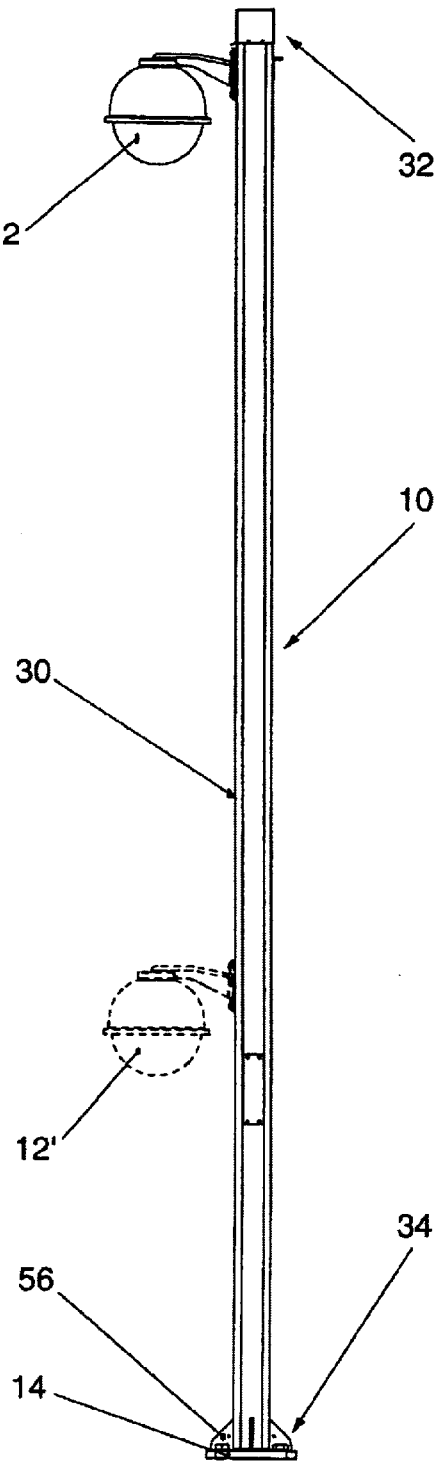
Figures 2A, 2B, 2C, 2D:
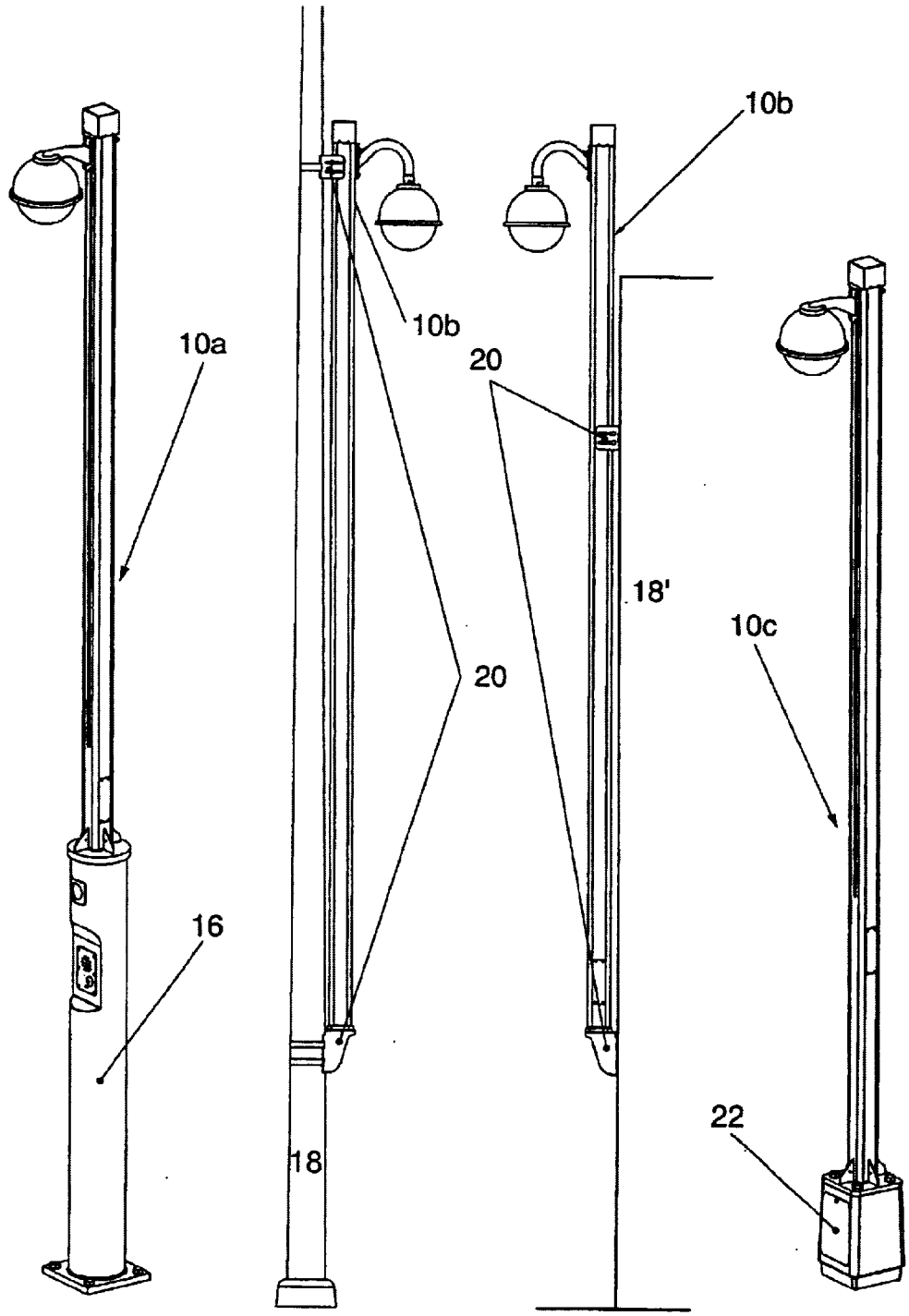
FIGS. 2*a*–2*d* show alternate mounting embodiments of a pole according to preferred forms of the present invention.

In one embodiment, described with reference to FIGS. 1*a* and 1*b*, the support pole 10 includes a base plate 14 for mounting to a sidewalk or other surface, as with anchor bolts or other attachment means. In an alternate embodiment shown in FIG. 2*a*, the support pole 10 is mounted to a telephone emergency call station 16. In another alternate embodiment shown in FIG. 2*b*, the support pole 10 is mounted to an existing pole such as a telephone pole or sign pole, preferably using mounting brackets 20. In still another alternate embodiment shown in FIG. 2*c*, the support pole 10 is mounted to a wall 18 or other structure. In yet another alternate embodiment shown in FIG. 2*d*, the support pole 10 is mounted to a transformer base 22 or other enclosure.

The support pole 10 preferably comprises an elongate pole portion 30, having a top 32, a bottom 34, and a channel 36 extending at least partly between the top and the bottom. The elongate pole portion 30 is preferably formed as an extrusion of a substantially rigid material such as aluminum, steel or plastic. In preferred form, the height of the elongate pole portion 30 is between about 10' to about 20', and most preferably about 16'. Of course, those skilled in the art will recognize that the height may be greater or less than the stated example dimensions, depending upon a particular intended application. For certain applications, the channel 36 will extend substantially the entire distance from the top 32 to the bottom 34, thereby allowing the supported object to be raised and lowered along substantially the entire length of the elongate pole portion 30. For example, if the support pole 10 is mounted to the top of a telephone call station 16, it may be desirable that the supported object 12 be lowered to immediately adjacent the bottom 34 of the elongate pole portion 30 to permit a person standing on the ground or on a short ladder to reach the supported object. For other applications, the channel 36 may extend along only a portion of the height of the elongate pole portion 30, ending a distance from either the top 32 or the bottom 34. For example, if the support pole 10 is mounted on the ground, it may be easier to service the supported object 12 at a position several feet above the ground than at ground level, in which instance the channel 36 need not extend all the way to the bottom 34 of the pole. Preferably, the lower position of the supported object 12 will be within or just above the reach of a person of average height, whereby a short ladder is utilized to access the supported object.

Above and below the channel 36, the elongate pole portion 30 is preferably a multi-sided or round extrusion having a partially hollow interior comprising one or more chambers extending substantially continuously along the height of the pole. For example, as seen with reference to FIGS. 3 and 4, the elongate pole portion 30 preferably comprises first and second side walls 40, 42, a back wall 44, and a front wall 46. Outer surfaces of the elongate pole portion 30 can optionally be provided with fluting or other decorative features, and/or informational indicia such as signage. One or more recesses are preferably formed in the outer surface of the pole 30 to receive changeable graphics for aesthetic, advertising or identification purposes. The front wall 46 preferably defines an opening or slot 48 extending at least partly along its length, defining the opening to the channel 36. A gasket 50 preferably seals the slot 48 to prevent external elements such as rain, dust, insects and debris from entering into the interior chambers of the pole, but to allow passage of a carriage (described below) through the slot. In preferred form, the gasket 50 comprises cooperating first and second ribs formed of a resilient material such as rubber. The elongate pole portion 30 is preferably extruded to include keeper slots on opposed sides of the slot 48 to hold the gasket ribs. Alternatively, the gasket 50 can be affixed along the slot 48 by fasteners or adhesive.

Figure 3:
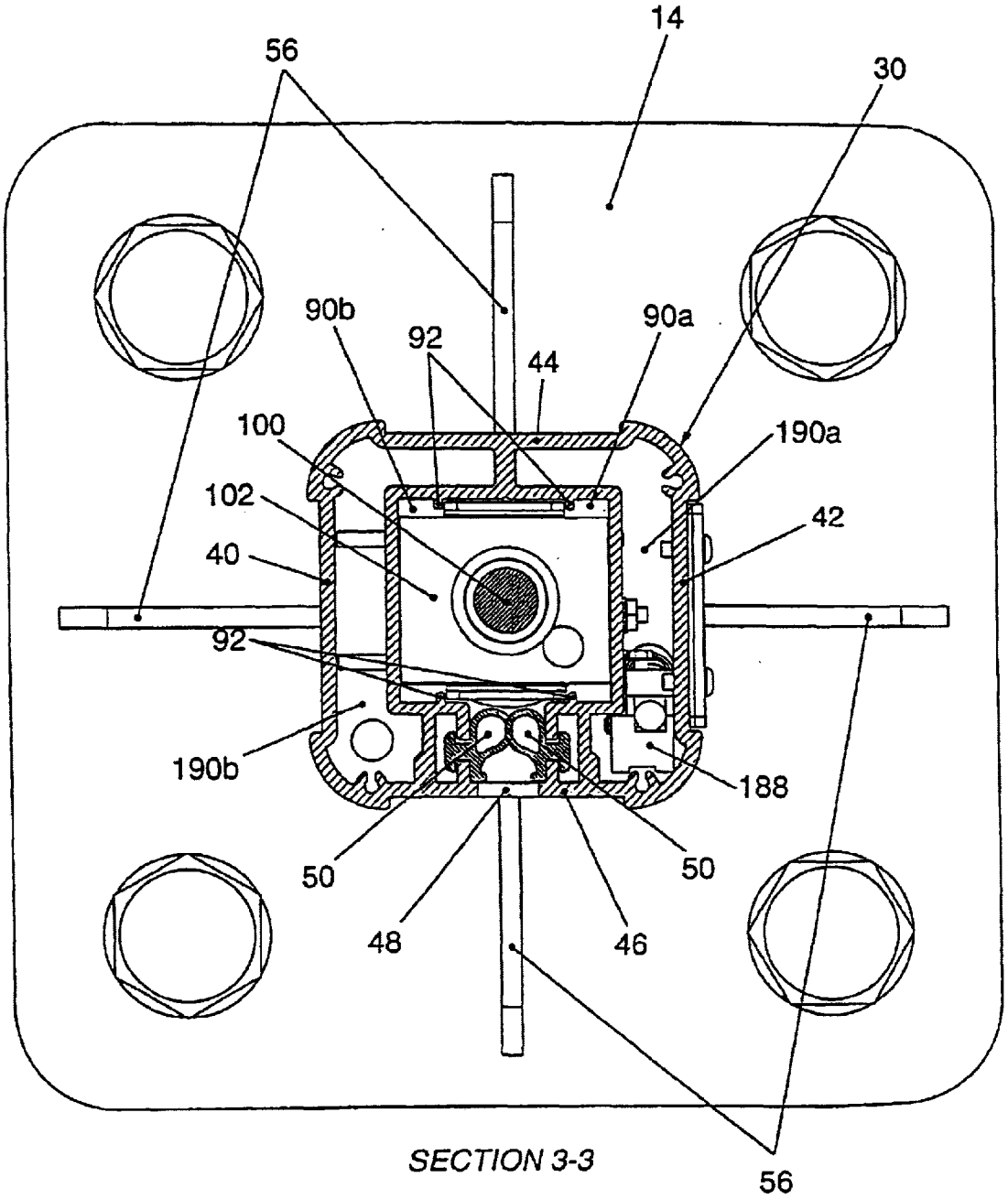
FIG. 3 shows a cross-sectional view of a portion of the pole of FIG. 1, taken at section line 3—3, according to a preferred form of the present invention.
Figures 7A, 7B:
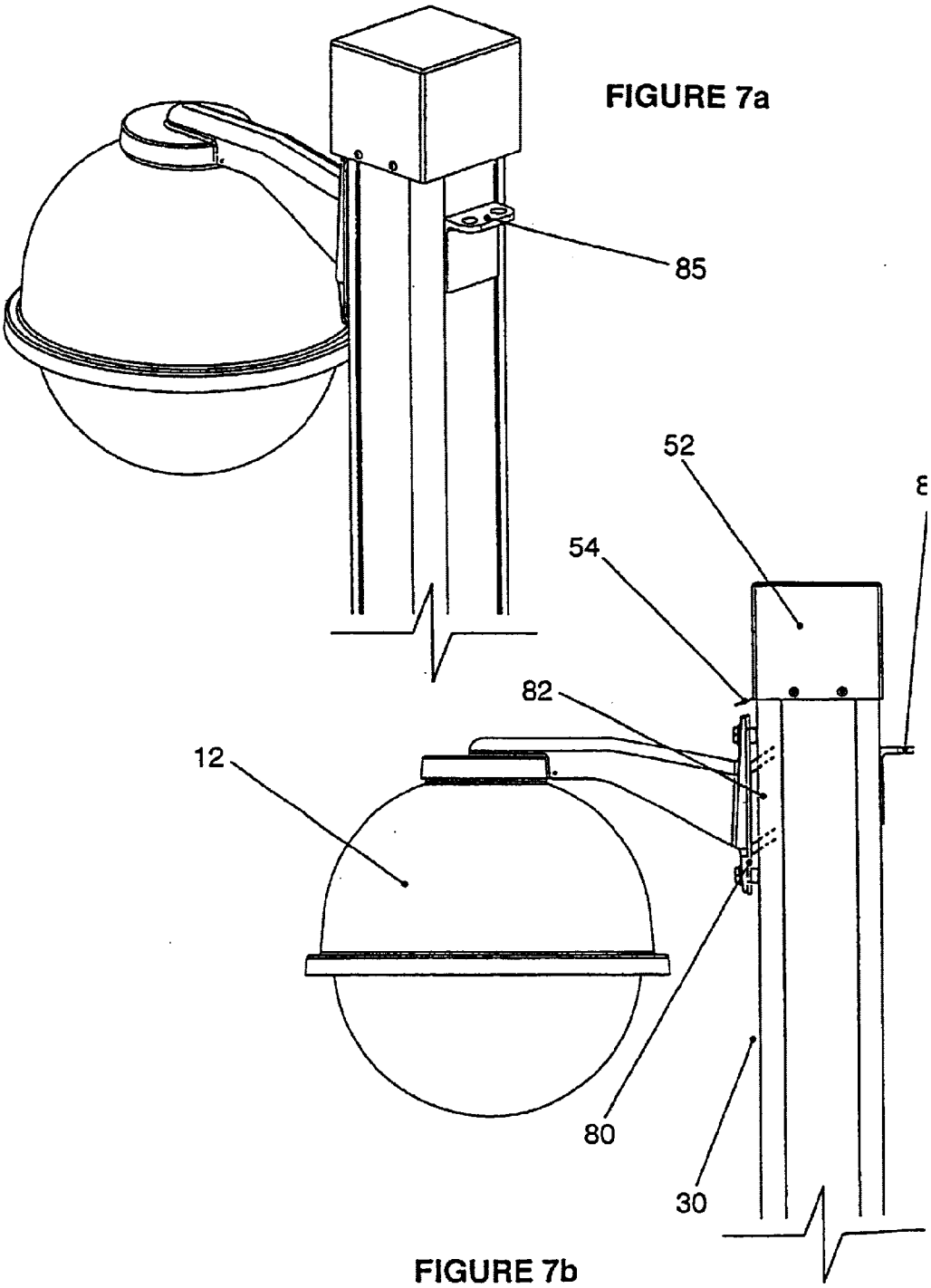
FIGS. 7*a* and 7*b* show a perspective view and a side elevational view, respectively, of an upper portion of the pole of FIG. 1, supporting a supported object in an elevated position.
Figure 8:
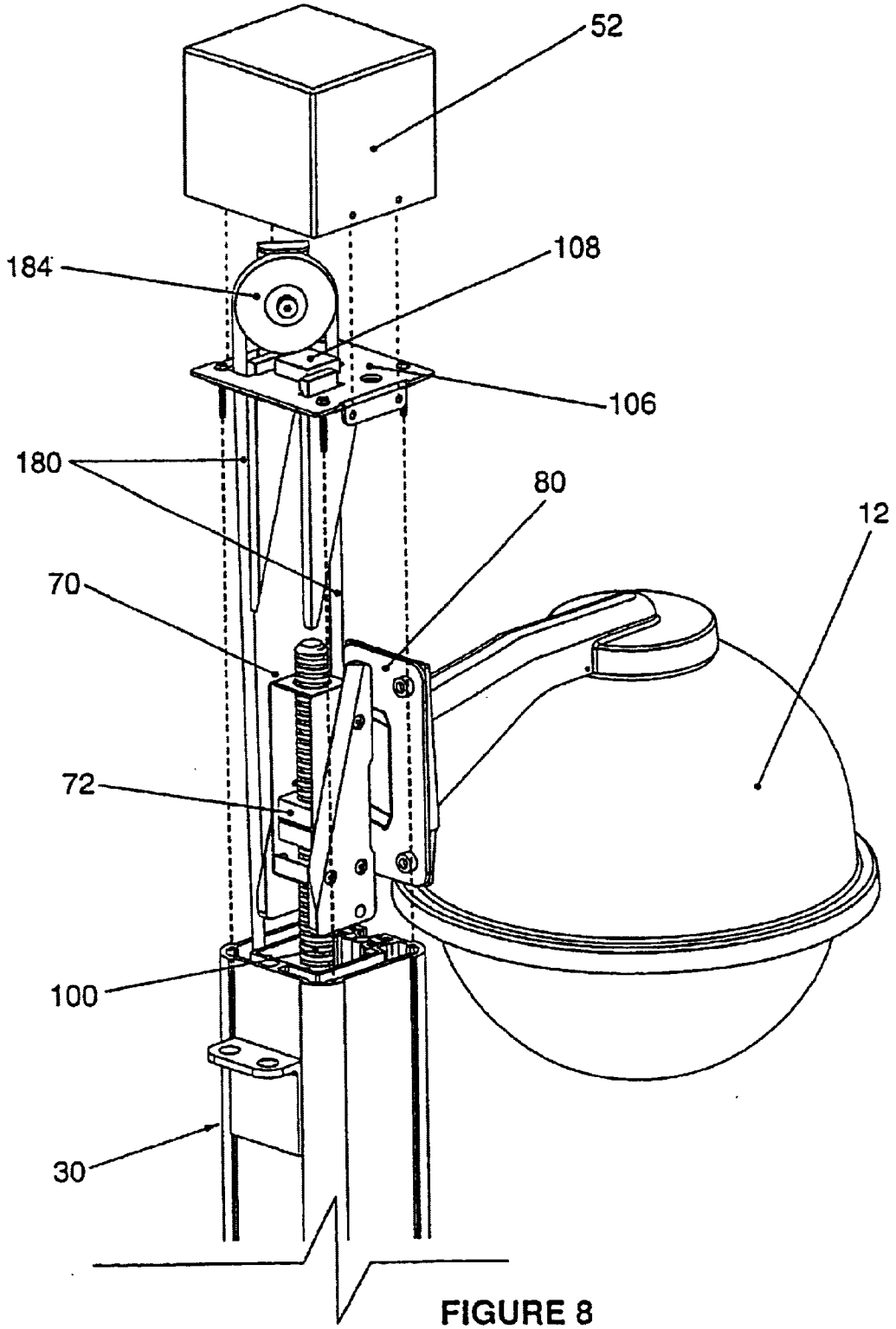
FIG. 8 shows an assembly view of carriage transport portions of the pole of FIG. 1, according to a preferred form of the present invention.
Figure 9:
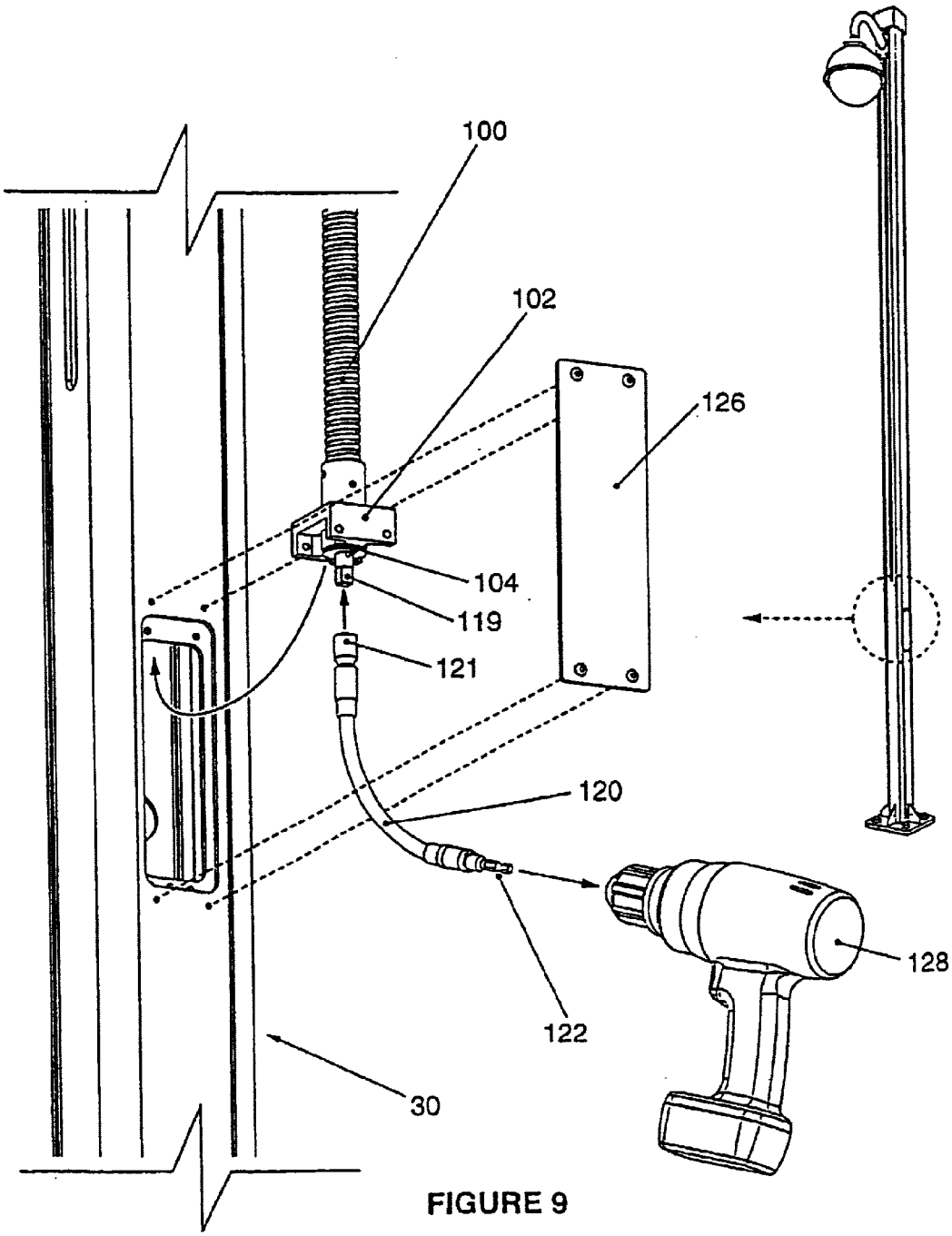
FIG. 9 is an exploded perspective view showing details of drive portions of the pole of FIG. 1, according to a preferred form of the present invention.
Figure 10:
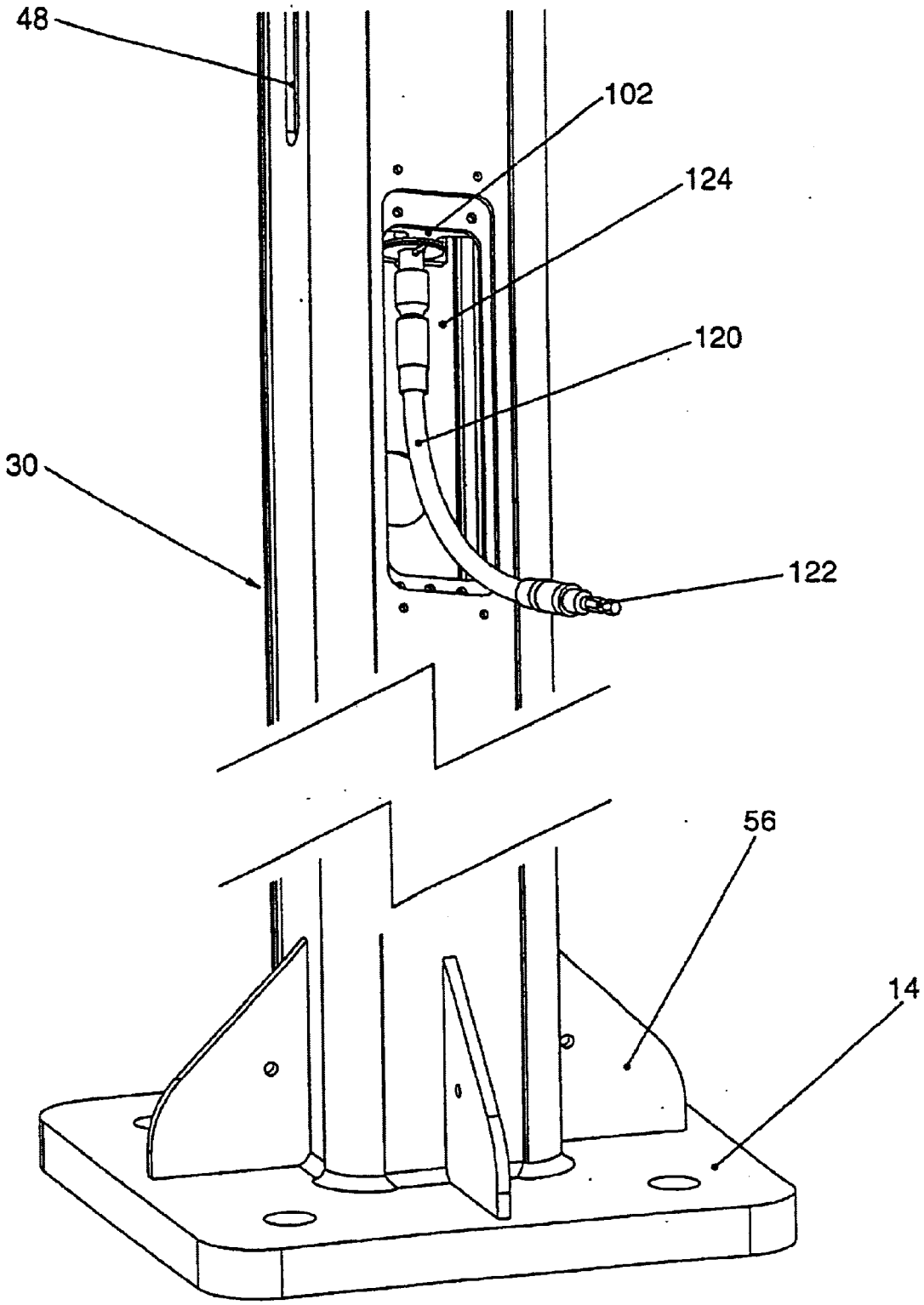
FIG. 10 is an assembled perspective view of a base portion of the pole of FIG. 1, according to a preferred form of the present invention, showing a flexible drive shaft portion extended out of the pole's interior.

An endcap 52 is preferably attached at the top 32 of the elongate pole portion 30, as can be seen with reference to FIGS. 7–8. Alternatively, a flashing light or other indicator can be attached at the top 32 of the elongate pole portion 30, for example, to indicate the location of a telephone call station. The endcap 52 preferably comprises a drip ledge 54 overhanging the front wall 46 to prevent rain from running into the slot 48. A lifting bracket 85 is preferably affixed to the pole 10 adjacent the top 32. The lifting bracket 85 preferably comprises one or more openings or couplers for connection to a crane or other external lifting mechanism during installation, and/or for mounting a lightning rod or other component to the pole. One or more flanges 56 preferably provide structural bracing at the bottom 34 of the elongate pole portion 30, as shown in FIGS. 1 and 3. The bottom portion 34 of the pole preferably defines an interior chamber providing sufficient space to house any electronics and other equipment necessary for operation of the supported object.

Figure 4:
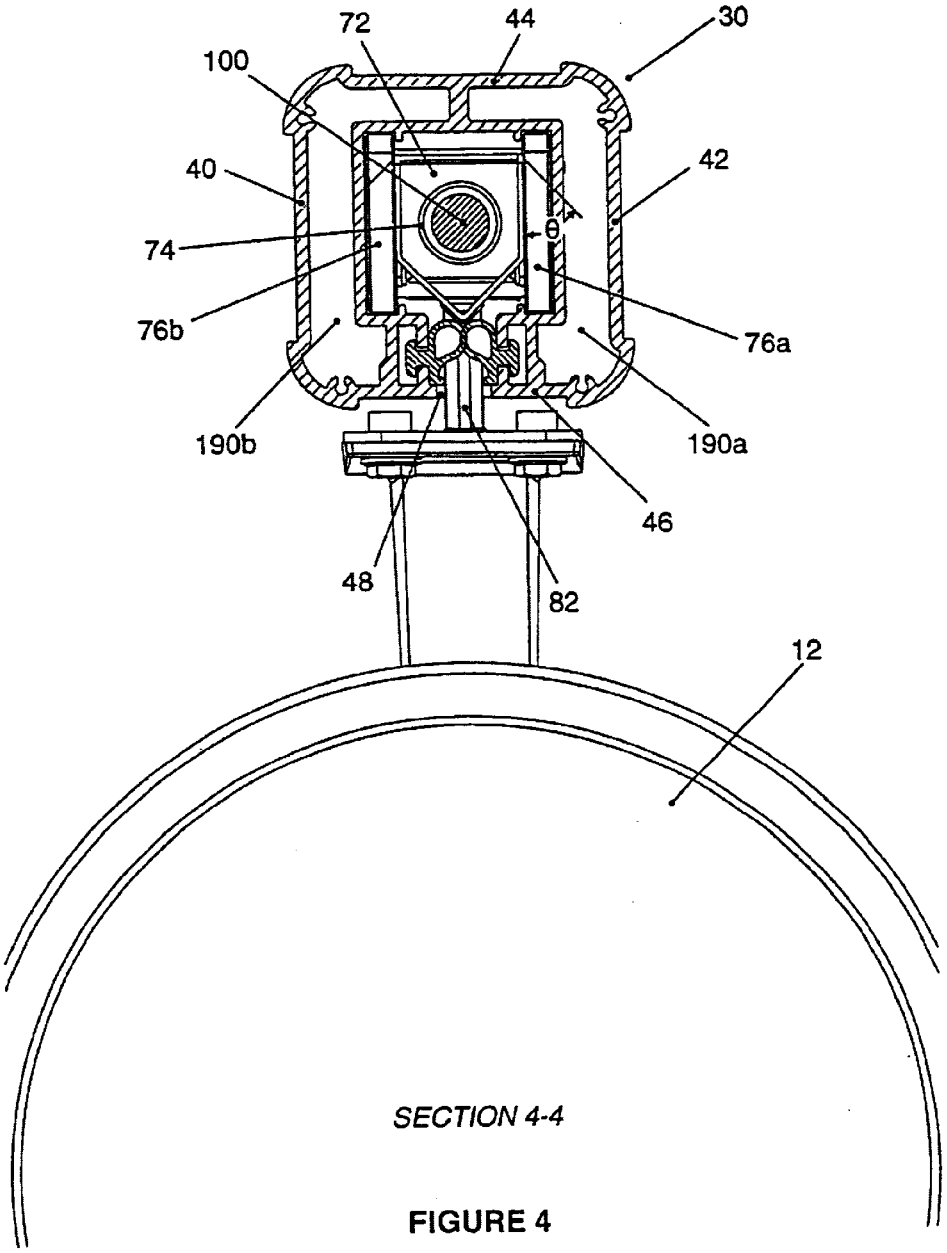
FIG. 4 shows another cross-sectional view of a portion of the pole of FIG. 1, taken at section line 4—4, according to a preferred form of the present invention.
Figures 5A, 5B:
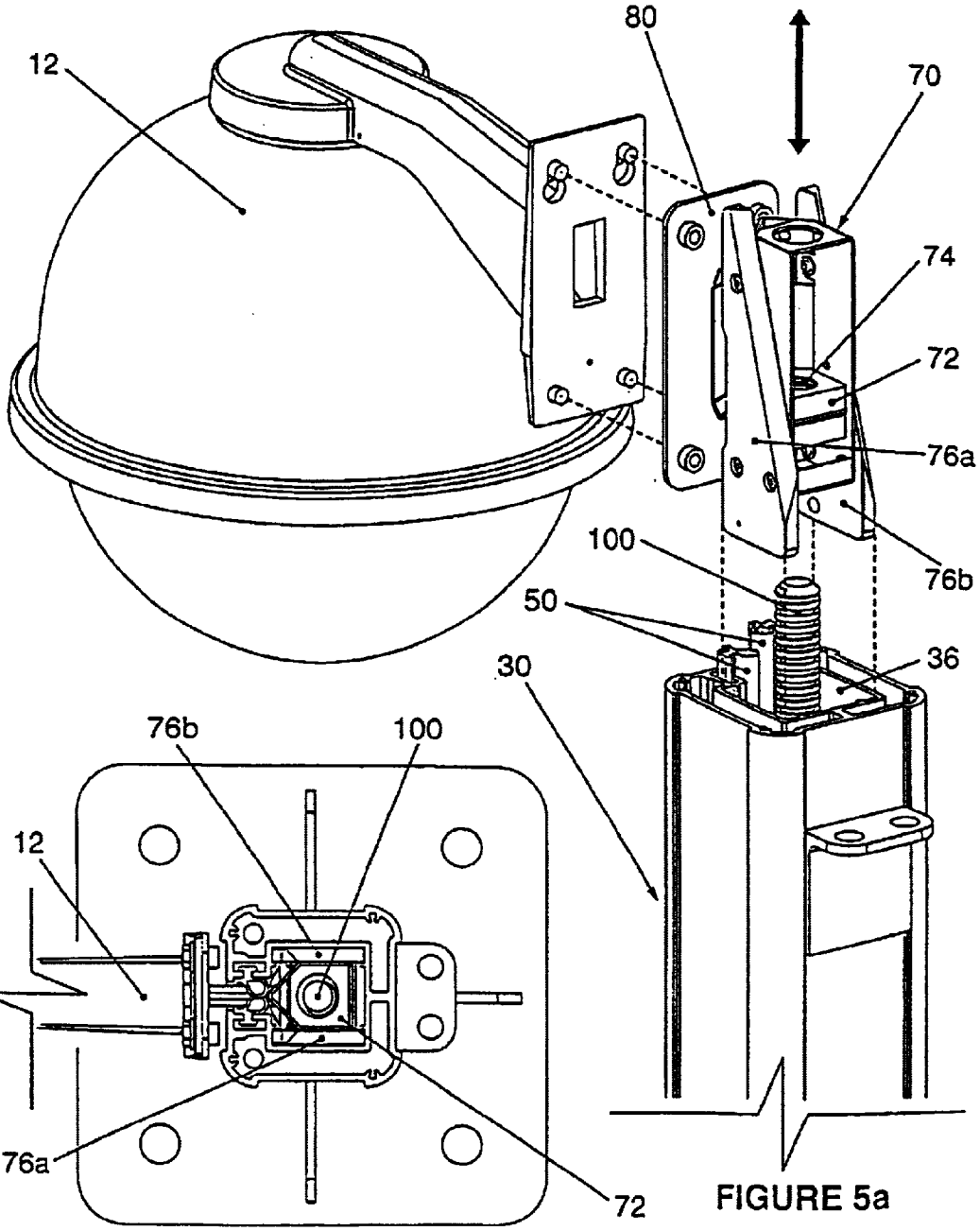
FIGS. 5*a* and 5*b* show an exploded perspective view and a top sectional view, respectively, of a carriage portion and elongate pole portion of the pole of FIG. 1, according to a preferred form of the present invention.
Figure 6:
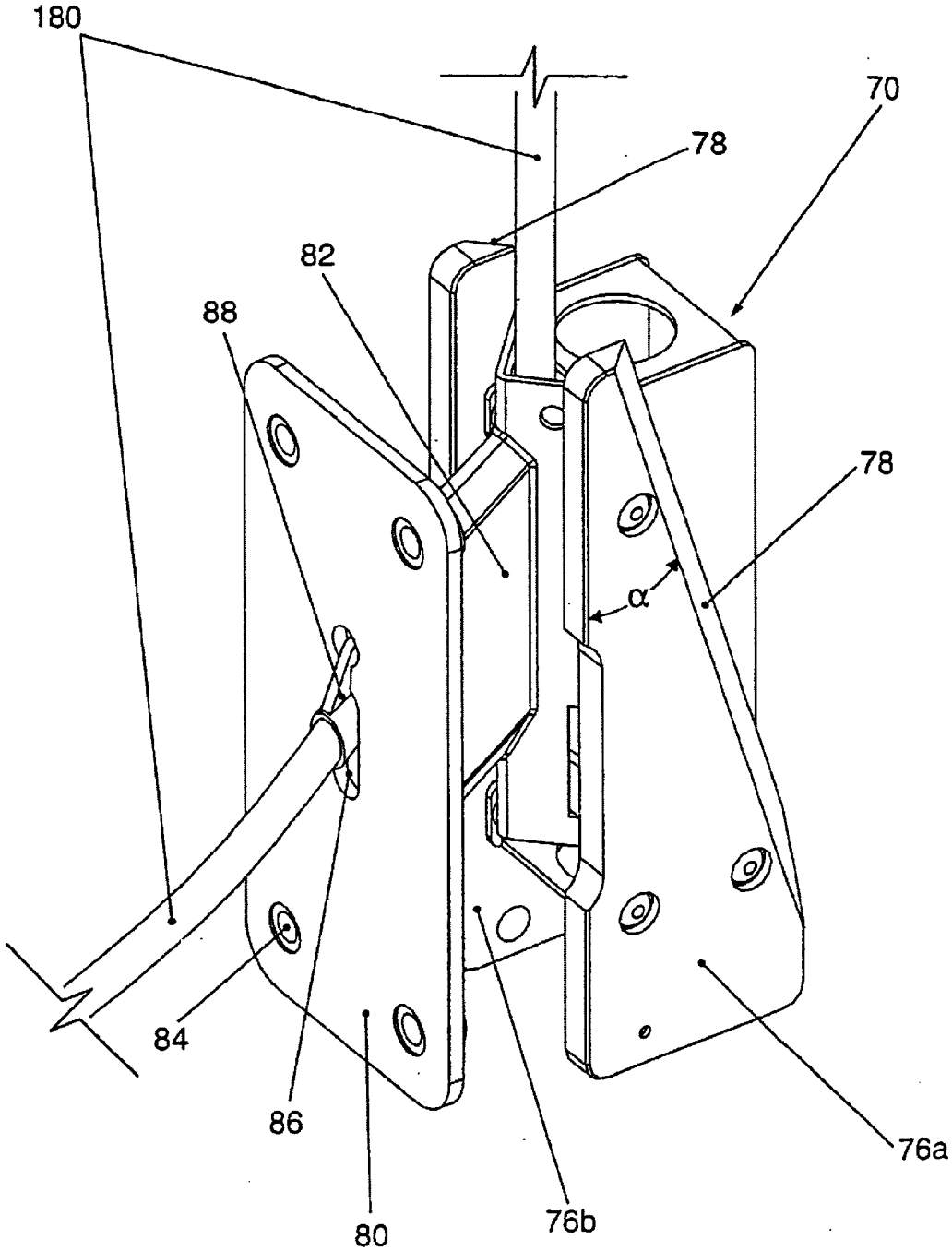
FIG. 6 shows a perspective view of the carriage portion of the pole of FIG. 1, according to a preferred form of the present invention.

With reference now to FIGS. 5 and 6, the support pole 10 preferably further comprises a carriage 70, mounted for translational movement within the channel 36, between a lower position and an elevated position. The carriage 70 preferably comprises a carriage body portion 72 defining a threaded bore 74 aligned generally coaxially with the elongate pole portion 30, and generally parallel to the slot 48 of the channel 36. The carriage 70 preferably further comprises one or more carriage guides 76. Most preferably, first and second carriage guides 76*a*, 76*b* are mounted on opposite sides of the carriage body 72. Each carriage guide 76 is preferably generally wedge-shaped when viewed from the side, in a viewing direction perpendicular to the axis of the bore 74; and is generally rectangular in cross-section when viewed end-on, in a viewing direction parallel to the axis of the bore 74. Each carriage guide 76 preferably includes a beveled, inclined surface 78, facing toward the top 32 of the elongate pole portion 30. For example, as seen best with reference to FIGS. 5 and 6, the surface 78 is preferably inclined at an acute angle a relative to the axis of the bore 74; and as seen best with reference to FIG. 4, the surface 78 is preferably beveled at an angle θ relative to the sides of the carriage guide 76.

With reference now to FIGS. 5–7, the carriage preferably further comprises a mounting bracket 80 attached to the carriage body 72 by a connecting strut 82. The connecting strut 82 preferably traverses the slot 48 along the length of the channel 36, between and in sealing contact with the ribs of the gasket 50. The connecting strut 82 preferably has rounded edges to prevent damage to the gasket 50, and slopes downwardly from the carriage body 72 to the mounting bracket 80, toward the bottom 34 of the elongate pole portion 30, so that any rainwater contacting the strut 82 runs toward the exterior of the channel 36. The mounting bracket 80 is preferably a generally flat metal plate, offset a small distance outside the channel 36, and preferably does not physically contact the channel. The mounting bracket 80 preferably traverses immediately adjacent and external of the channel 36, and is sized and shaped to substantially cover any opening formed between the gasket 50 and the strut 82 as the gasket parts to permit passage of the strut, thereby excluding any rain or debris from entering the interior of the channel. The mounting bracket 80 preferably defines one or more holes 84 for receiving bolts or other fasteners for attaching a supported object 12 to the carriage 70. The holes 84 can be internally threaded or can be unthreaded through holes. The mounting bracket 80 preferably also defines a cable opening 86 for passing a cable connecting the supported object 12 to a remote location. The strut 82 preferably defines a conduit in communication with the cable opening 86, and a cable clamp 88 is preferably mounted to the carriage 70 for securing the cable thereto.

As seen best with reference to FIGS. 3–5, the elongate pole portion 30 preferably comprises one or more carriage guide tracks 90 extending lengthwise within the channel 36. Preferably, first and second guide tracks 90*a*, 90*b* are provided on opposite sides of the channel 36, extending generally parallel to and adjacent the sidewalls 40, 42. Each track 90*a*, 90*b* is preferably configured to engage a respective carriage guide 76*a*, 76*b*, and constrain the carriage 70 to translational movement along the longitudinal axis of the channel 36, thereby preventing any significant twisting, pivotal or transverse movement of the carriage. Each track 90*a*, 90*b* is preferably formed as part of the channel 36 by extruding an opposed pair of fins 92 along the interior front and back surfaces of the channel. The tracks 90*a*, 90*b* and the carriage guides 76*a*, 76*b* preferably comprise contacting surfaces presenting a low coefficient of friction, whereby the carriage 70 slides smoothly within the channel 36. For example, the tracks 90*a*, 90*b* are preferably formed of smooth aluminum, and the carriage guides 76*a*, 76*b* are preferably formed of ultra-high molecular weight (UHMW) polyethylene. In alternate embodiments, the tracks 90 may be periodically lubricated if needed, and/or self-lubricating materials of construction can be utilized.

The support pole 10 preferably further comprises a drive mechanism for imparting translational movement of the carriage 70 along the channel. In preferred form, the drive mechanism is substantially entirely housed within the elongate pole 30, thereby protecting the drive mechanism from the elements, shielding personnel from injury by contact with moving parts, and improving the aesthetics of the overall device. With particular reference now to FIGS. 3, 4 and 8–10, the drive mechanism preferably comprises a threaded rod 100 rotationally mounted within the channel 36, and extending between the elevated position and the lower position. The threaded rod is preferably between about ¾" to 1" in diameter, and has an Acme single thread profile with a pitch of about six threads per inch (6 tpi). Of course, the size and thread characteristics may vary depending upon the particular application. A support bracket or block 102 is preferably mounted in the base of the elongate pole portion 30, adjacent the bottom 34, for supporting the threaded rod 100. A bearing 104 is preferably provided between the support bracket 102 and the threaded rod 100 to facilitate smooth rotation and constrain the bottom end of the rod in position, preventing any significant axial or transverse motion of the rod. A top plate 106 is preferably mounted at the top 32 of the elongate pole portion 30, and defines an opening and/or bearing 108 constraining the top end of the rod 100 to rotational motion. The threaded rod 100 preferably engages the threaded bore 74 of the carriage 70, whereby rotation of the rod 100 imparts translational movement upon the carriage 70 through the channel 36. Rotation of the rod 100 in a first rotational direction (e.g., clockwise) thereby imparts translation of the carriage 70 along the channel 36 in a first direction (e.g., upwardly), and rotation of the rod 100 in a second rotational direction (e.g., counterclockwise) thereby imparts translation of the carriage 70 along the channel 36 in a second direction (e.g., downwardly).

The threaded rod 100 is preferably connected to a detachable coupling for engagement of a drive tool 128. For example, the lower end of the rod 100 preferably comprises a first element of a detachable coupling 119, adapted to cooperatively engage a second detachable coupling element of a flexible drive shaft 120 at a first end 121 of the flexible drive shaft. Alternatively, the flexible drive shaft 120 can be permanently coupled to the rod 100. The second end 122 of the flexible drive shaft 120 is preferably releasably or permanently coupled to a drive tool 128. The drive tool 128 can be manually driven, such as a wrench or a handcrank, or can be power driven, such as an electrical or pneumatic motor. In a particularly preferred form, the coupling is adapted to detachably couple with a portable cordless drill-motor. The flexible drive shaft 120 can be permanently or detachably coupled to the threaded rod 100. In preferred form, and as seen with reference to FIGS. 9 and 10, the flexible drive shaft 120 has a length that permits the shaft to be housed within the interior of the base of the elongate pole portion 30, beneath the support bracket 102, when not in use; and to be accessed for use through an access opening 124 in the elongate pole portion 30, whereby the coupling 122 can be withdrawn to a position external of the elongate pole portion 30 for connection to the drive tool. A cover plate 126 preferably covers the access opening 124 when the drive shaft 120 is not in use.

Figure 11A:
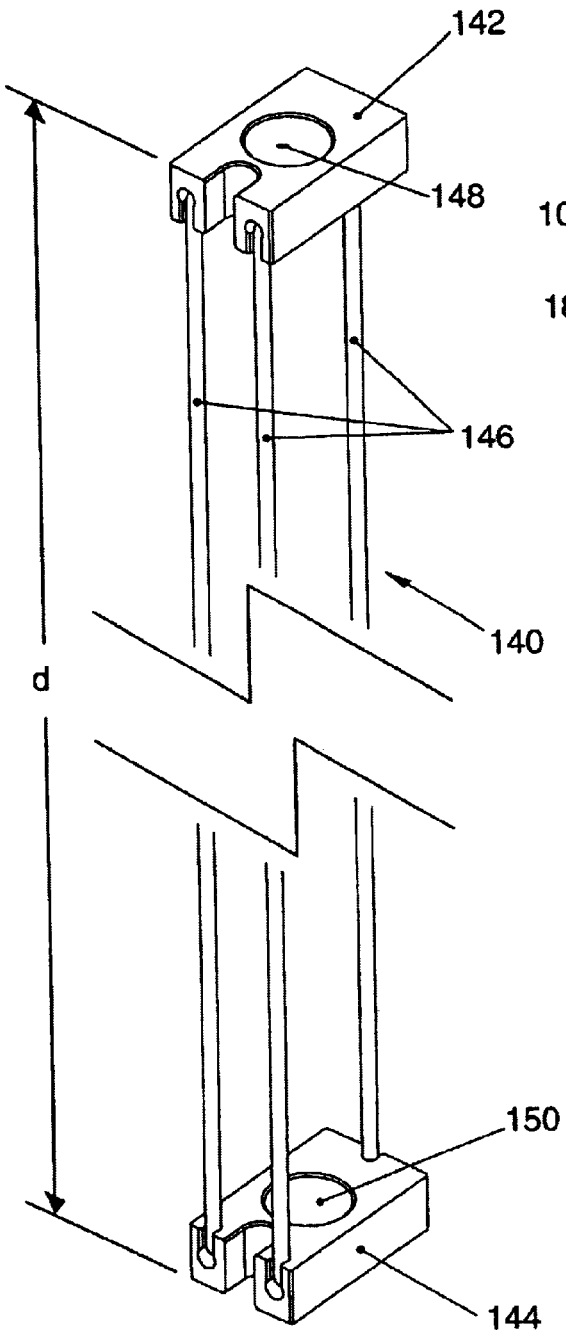
FIGS. 11*a* and 11*b* show separate and assembly views, respectively, of a stabilizer frame portion of the pole of FIG. 1, according to a preferred form of the present invention.
Figure 11B:
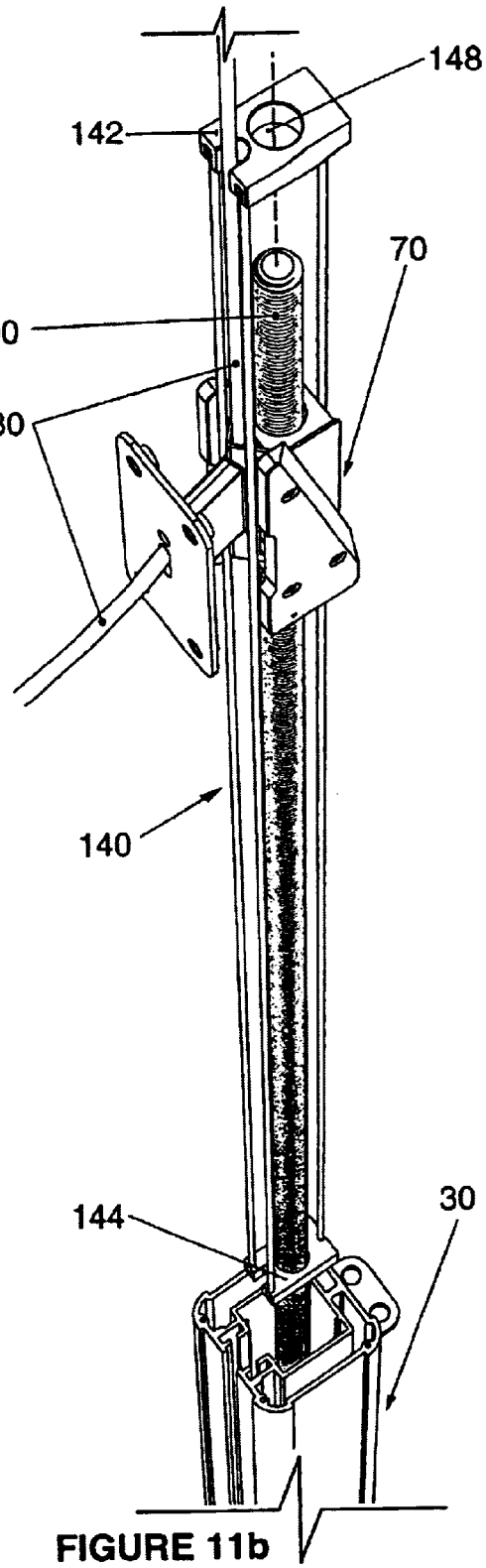

With reference to FIGS. 11*a* and 11*b*, the support pole 10 preferably further comprises a stabilizer frame 140, for bracing the threaded rod 100 to reduce vibration during rotation of the rod 100. The stabilizer frame generally comprises an upper stabilizer block 142, a lower stabilizer block 144 spaced a distance d from the upper plate, and one or more connecting members 146 extending between the upper and lower blocks. The distance d is preferably about ⅓ to ½ the length of the threaded rod 100. Each of the upper and lower blocks 142, 144 define an opening 148, 150 having an inner diameter approximately equal to or slightly larger than the outer diameter of the threaded rod 100. The upper and lower blocks 142, 144 are preferably formed of UHWM polyethylene or other low-friction material. The stabilizer frame is mounted within the channel 36, with the threaded rod 100 engaged within the openings 148, 150, and with the carriage 70 between the upper and lower blocks 142, 144. The upper and lower blocks 142, 144 are preferably sized and shaped to slide in close registration within the channel 36, for example, between the fins 92 forming the guide tracks 90. In this manner, the upper and lower blocks provide bracing against lateral vibration of the rod 100 as the rod is rotated. The stabilizer frame is preferably carried along with the carriage 70 as the carriage traverses the channel 36. For example, if the distance d between the upper and lower blocks 142, 144 is about ½ the length of the threaded rod 100, the upper block 142 will brace the threaded rod near the midpoint of the rod's length when the carriage 70 is below the midpoint of the rod's length. As the carriage 70 moves upwardly along the channel 36, the top of the carriage will contact the upper block 142, and carry the stabilizer frame 140 upwardly through the channel. When the carriage 70 reaches the top of the channel, the lower block 144 of the stabilizer frame 140 will be positioned at about the midpoint of the threaded rod 100. Because the threaded rod 100 is constrained against lateral deflection at its top and bottom ends by bearings 108, 104, respectively, in the absence of the bracing provided by the stabilizer frame, the rod would be prone to maximum vibratory deflection at or near its midpoint. Thus, by providing a stabilizer frame having a distance d between blocks 142, 144 of ⅓ to ½ the length of the rod 100, the threaded rod is braced at or near the point of greatest susceptibility to vibration throughout the traverse of the carriage 70.

Figure 12:
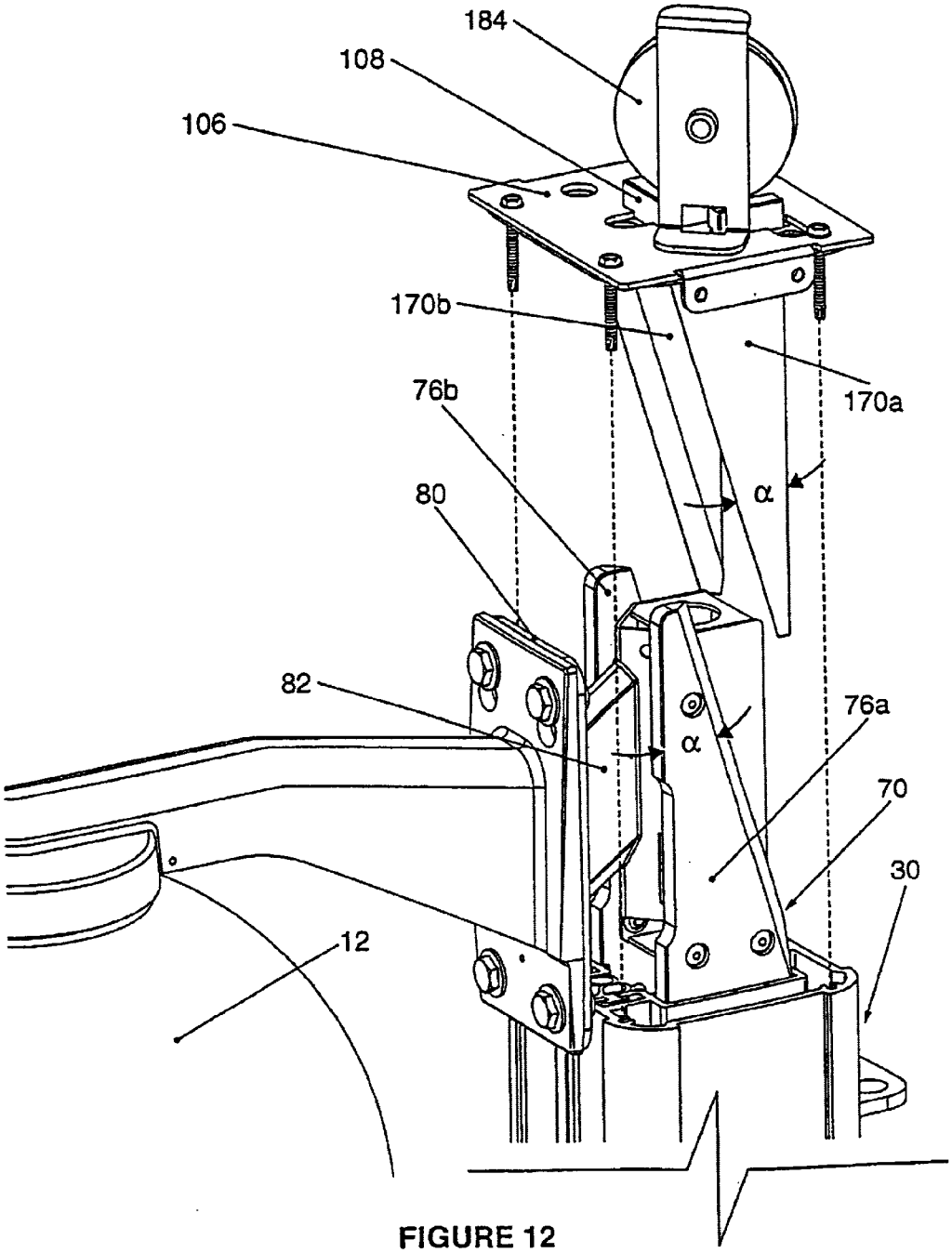
FIG. 12 shows an exploded perspective view of the carriage, carriage lock and pulley portions of the pole of FIG. 1, according to a preferred form of the present invention.

The support pole 10 of the present invention preferably further comprises at least one carriage lock, which will be described with particular reference to FIG. 12. In preferred form, a pair of carriage locks 170*a*, 170*b* are affixed within the guide tracks 90*a*, 90*b*, adjacent the top 32 of the elongate pole 30, for example by attachment to the top plate 106. The carriage locks 170*a*, 170*b* comprise beveled, inclined surfaces supplementary to the beveled, inclined surfaces 78 of the carriage guides 76*a*, 76*b*. As the carriage 70 is raised into the elevated position adjacent the top 32 of the elongate pole 30, the beveled, inclined surfaces of the carriage guides 76*a*, 76*b* contact and engage the beveled, inclined surfaces of the carriage locks 170*a*, 170*b* to lock the carriage 70 in position and thereby prevent vibration and lateral movement of the supported object 12 in the elevated position. The cooperating beveled, inclined surfaces provide increased surface area of contact between the carriage locks 170*a*, 170*b* and the carriage guides 76*a*, 76*b*, and provide compressive forces therebetween in both an axial and a lateral direction, thereby providing more solid bracing against movement and vibration than would be provided by contact between non-inclined and/or non-beveled surfaces.

Figure 13:
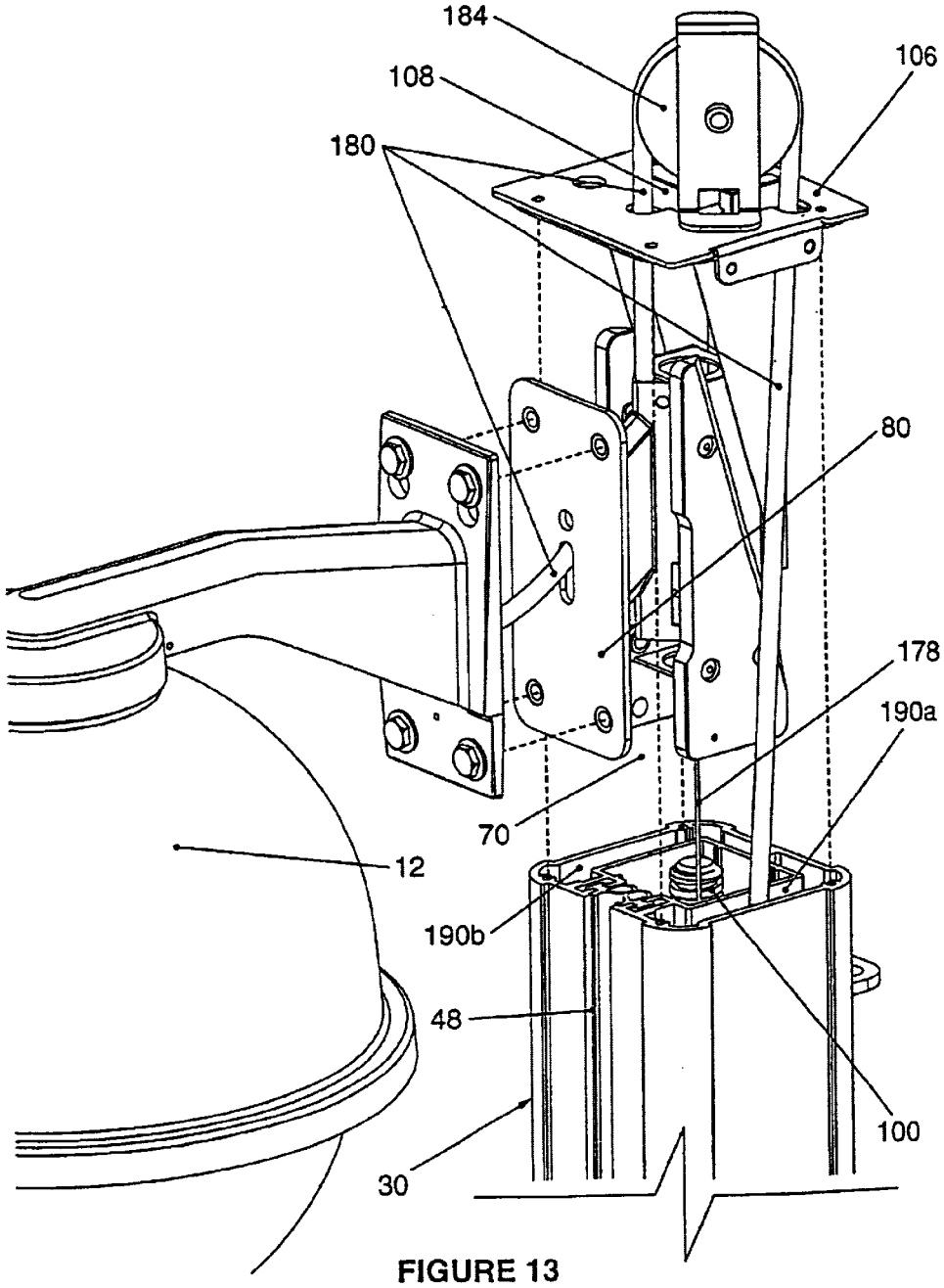
FIG. 13 is an exploded perspective view of a top portion of the pole of FIG. 1, showing cable and carriage transport portions of the pole, according to a preferred form of the present invention.
Figure 14C:
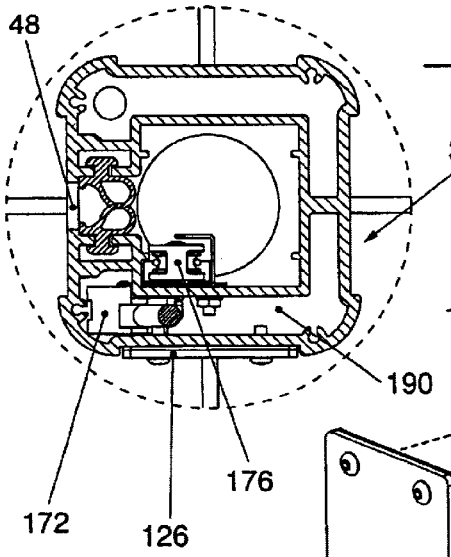
FIGS. 14*a* and 14*b* are perspective assembly views of first and second alternate embodiments of a base portion of the pole of FIG. 1, showing cable transport portions of the present invention, depicted exterior of the pole for clarity.
Figure 14A:
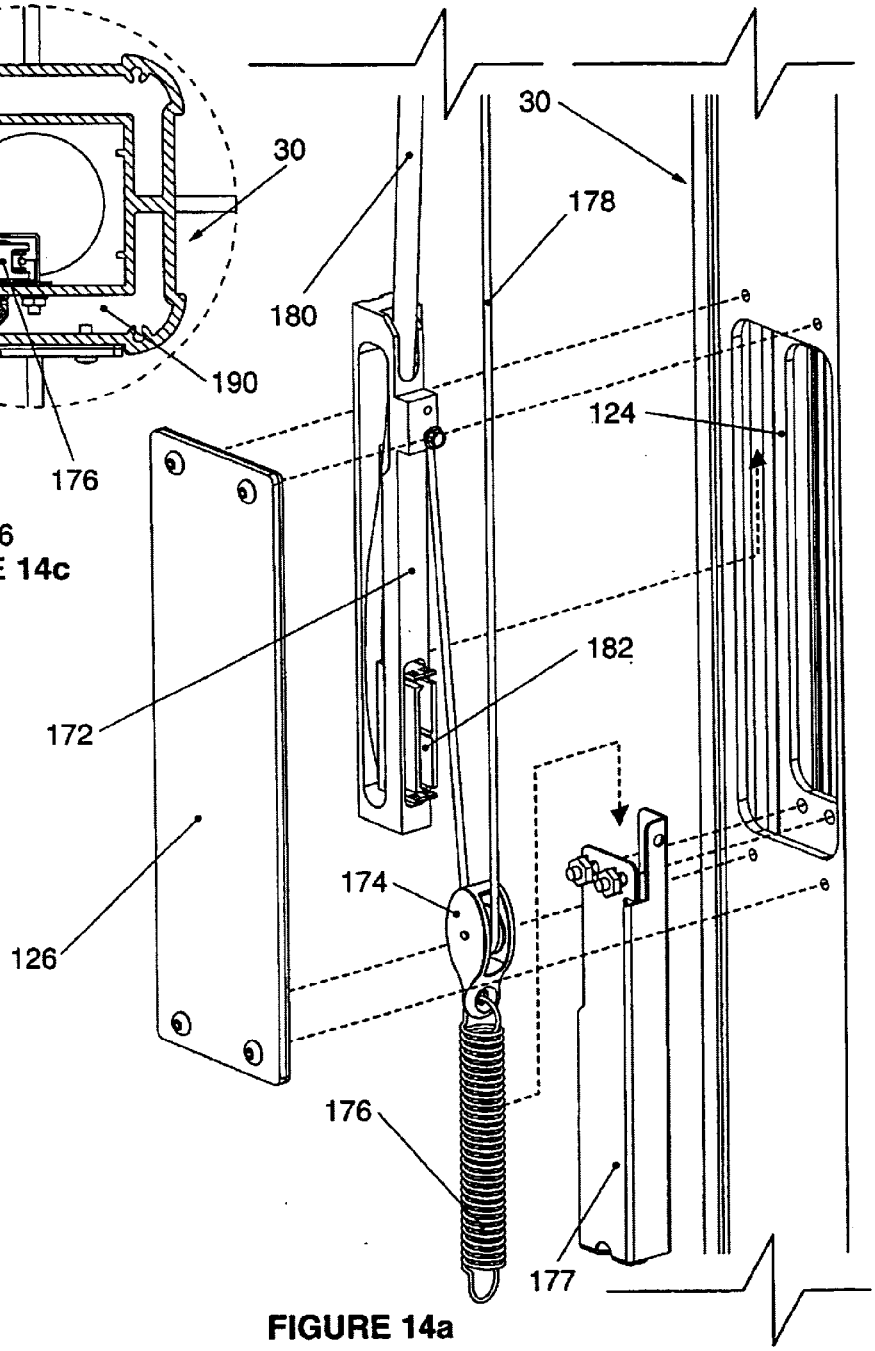

In many instances, the supported object 12 must be coupled, electronically or otherwise, to one or more remote devices and/or power sources. For example, a supported surveillance camera is typically coupled electronically and/or optically to a remote power source and to remote monitoring and/or recording devices. The support pole 10 of the present invention preferably further comprises a cable transport mechanism for coupling the supported object 12 to a remote device and permitting the supported object to be raised and lowered between the elevated and lower positions. With reference now to FIGS. 6, 13 and 14*a*, the support pole 10 preferably comprises a cable 180, having a first end connected to the supported object 12, and a second end comprising a detachable coupling 182 for detachable connection with a cooperating coupling adjacent the bottom 34 of the elongate pole 30. Adjacent its first end, the cable 180 is preferably attached to the carriage 70 by the cable clamp 88 and extends through the cable opening 86 in the mounting bracket 80. An intermediate portion of the cable 180 between its first and second ends is preferably carried by a pulley 184 mounted to the top plate 106 beneath the endcap 52. When the carriage 70 is raised to the elevated position, the cable 180 extends over the pulley 184, and the second end of the cable reaches to a position adjacent the bottom 34 of the elongate pole 30 where its coupling 182 is connected to a cooperating coupling to complete the connection between the supported object 12 and the external device and/or power source. The coupling 182 is detached to lower the supported object to the lower position. As the carriage 70 is lowered through the channel 36, the first end of the cable 180 is carried downwardly with the carriage. The cable 180 passes over the pulley 184, and the second end and coupling 182 of the cable 180 are raised upwardly through the elongate pole 30. As seen best with reference to FIGS. 3, 4 and 13, the extrusion profile of the pole preferably defines at least one cable duct 190, extending along substantially the entire length of the pole 30, for enclosing the first end and intermediate portion of the cable 180 along its path of travel as the supported object is raised and lowered. In the depicted embodiment, first and second cable ducts 190*a*, 190*b* are arranged on opposite sides of the channel 36. The provision of the cable duct(s) 190 provide a protective enclosure for the cable 180, as well as for additional cables, wires or other equipment extending between the top and bottom of the pole, and helps prevent the cable 180 from kinking or snagging on adjacent structure as the supported object is raised and lowered.

The cable transport mechanism of the present invention preferably further comprises a return mechanism for retrieval of the cable 180 and for maintaining tension on the cable during transport. In a first preferred embodiment, the return mechanism comprises a connector block 172, a tension pulley 174 biased by a spring 176, and a return lanyard 178, as seen best with reference to FIG. 14*a*. The second end of the cable 180 comprising the coupling 182 is preferably attached to the connector block 172 by a clamp, a set screw, or other retainer. The connector block 172 is preferably shaped to slide freely within the cable duct 190 as the carriage 70 is raised and lowered. The return lanyard 178 is preferably a steel cable or other flexible element, having a first end attached to the connector block 172 and a second end connected to the carriage 70. An intermediate portion of the return lanyard 178 passes through and engages the tension pulley 174. In this manner, the cable 180 and the return lanyard 178 form a continuous loop around the upper pulley 184 and the lower tension pulley 174. As the carriage 70 is lowered, the connector block 172 and the first end of the lanyard 178 are raised upwardly through the cable duct 190; and as the carriage is raised, the connector block and first end of the lanyard return to the lower position adjacent the base of the pole. The spring 176 biases the tension pulley away from the upper pulley 184, to maintain the cable 180 and the return lanyard 178 in tension, so that they remain straight during travel and prevent kinking. The spring and pulley mechanism is preferably mounted to the pole 10 by a bracket 177. Components of the return mechanism are depicted externally of the pole for clarity in the perspective view of FIG. 14*a*, but in use are actually housed within the pole as shown in the cross-sectional detail of the assembled mechanism.

Figure 14B:
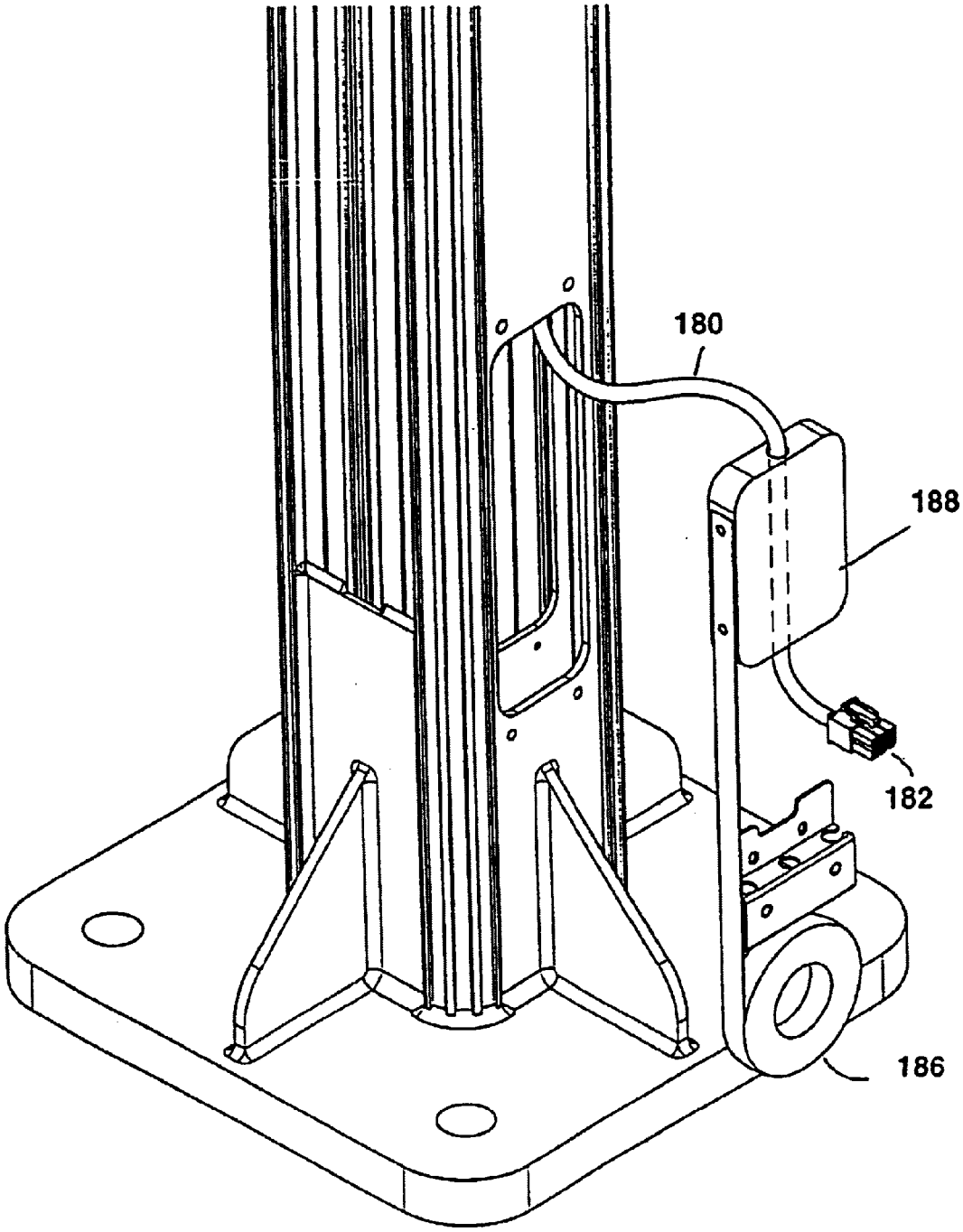

In an alternate embodiment depicted in FIG. 14*b*, the return mechanism comprises a return spring 186 such as a constant force coil spring, which is preferably attached to the second end of the cable 180 to retract the second end of the cable back to the bottom of the elongate pole 30 when the carriage is again raised to the elevated position. The return spring 186 maintains tension on the cable 180 throughout the traverse of the carriage, thereby preventing kinking of the cable and retaining the cable within the track of the pulley 184. The return spring 186 also serves as a security lanyard for retrieving or freeing the cable 180, should the cable become stuck as the supported object is raised or lowered. The return spring 186 is depicted externally of the elongate pole 30 in FIG. 14 for purposes of clarity; however, the return spring is preferably mounted within the interior of the elongate pole 30 in actual use. The housing or main body of the spring 186 is attached to the base of the pole 30 by a keeper, screw or other attachment means. The free end of the spring 186 is preferably attached to a spring guide 188, which is slidably mounted within one of the cable ducts 190*a*, 190*b*. The spring guide 188 is preferably a generally rectangular block of low-friction material, such as UHMW polyethylene sized and shaped to slide translationally within the cable duct 190, but to resist rotation or twisting. In this manner, because the free end of the spring 186 is affixed to the spring guide 188, the spring does not twist or tangle as it is uncoiled from its retracted state.

Figure 15:
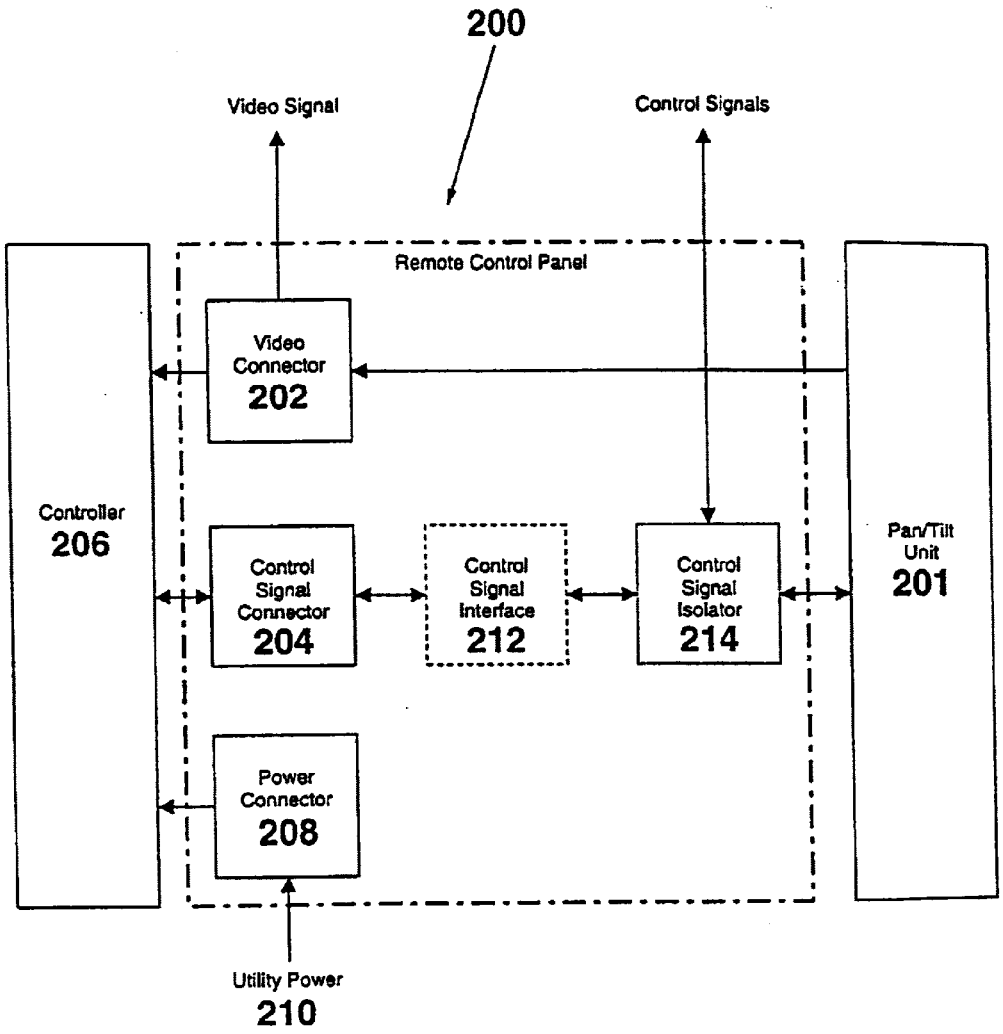
FIG. 15 is a schematic diagram of a remote control panel of the present invention, according to a preferred form.

The present invention optionally further comprises a remote control panel 200 mounted to the base of the support pole 10, which allows a user to verify the operation of a pan/tilt mechanism 201 of a surveillance camera housing carried as the supported object 12 in certain particular applications of the support pole. Provision of the remote control panel 200 permits testing of the pan/tilt mechanism 201 without the need for climbing a ladder or lowering the camera housing. As seen best with reference to FIG. 15, the remote control panel 200 preferably comprises a video connector 202 for connection to an external video monitor. The remote control panel 200 preferably further comprises a control signal connector 204 for connection of an external controller 206, such as a programmed computer, for selectively controlling the pan/tilt mechanism 201. A power connector 208 for connection to an external power source 210, and/or an internal power source (unshown) are also preferably provided. The remote control panel 200 is preferably connected to the communication and video lines that are used to normally control the pan/tilt mechanism 201 and transmit video signals, but does not affect the normal operation of the pan/tilt mechanism. Video output signals from the supported surveillance camera are transmitted via the video connector 202 to the connected video monitor as the controller 206 is operated to actuate the pan/tilt mechanism 201. The user observes the displayed image on the video monitor to verify the operation of the pan/tilt mechanism 201. The remote control panel 200 preferably also comprises a control signal interface 212 for converting the electrical signal levels from the controller 206 to the electrical signal levels of the pan/tilt mechanism 201. The remote control panel 200 preferably also comprises a control signal isolator 214 for isolating control wires from external equipment. The control signal isolator 214 can comprise means for manually isolating control wires from external equipment, or alternatively can comprise means for automatically isolating control wires from external equipment by detecting the presence of signals from the controller 206.

Figure 16A:
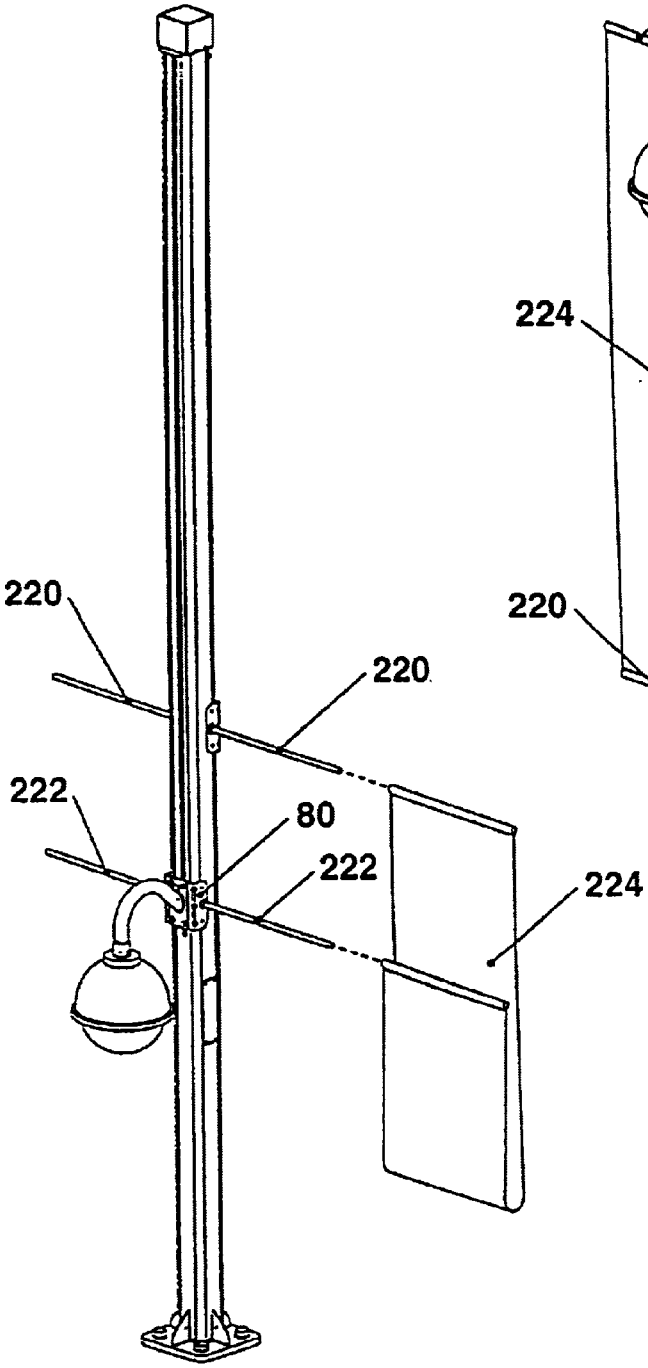
FIGS. 16*a* and 16*b* are perspective views of an alternate embodiment of the pole of the present invention, including banner display elements, shown in lowered and raised positions, respectively.
Figure 16B:
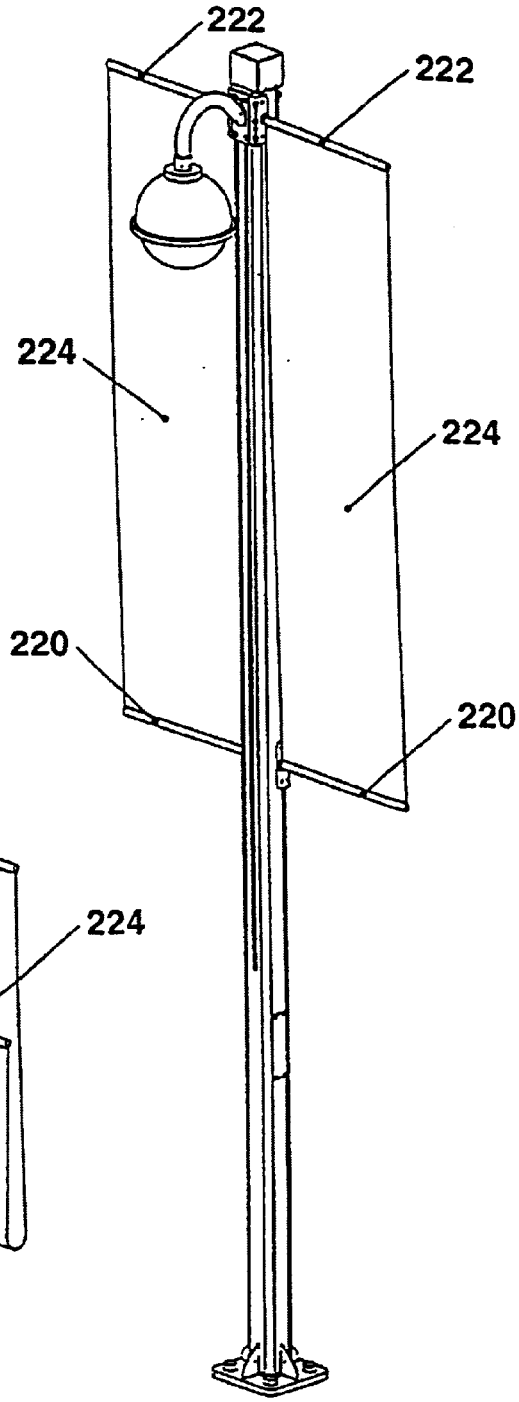

FIGS. 16*a* and 16*b* depict an alternate embodiment of the pole of the present invention, comprising a banner display system, shown in a lowered and a raised configuration, respectively. One or more lower banner posts 220 are preferably mounted to the pole between the top 32 and the bottom 34. Two lower banner posts 220 are depicted, permitting a pair of banners to be displayed simultaneously. The lower banner posts 220 are optionally detachably mounted to the pole to permit selective positioning depending upon the size of the banner to be displayed. Alternatively, the lower banner posts 220 are permanently mounted in a fixed position on the pole. One or more upper banner posts 222 are preferably mounted to the carriage 70, whereby the upper banner posts are raised and lowered along with the carriage. The mounting bracket 80 is preferably modified to include one or more side flanges for mounting the upper banner post(s) 222. In use, the bottom of a banner 224 is secured to the lower banner posts 220, and the top of the banner is secured to the upper banner posts 222. The carriage 70 and attached upper banner post(s) 222 are lowered to install and remove the banner(s) 224, and raised to display the banner(s).

In operation, a supported object such as a surveillance camera is mounted to the mounting bracket 80. The carriage 70 is preferably lowered to the lower position shown in broken lines in FIG. 1 for installation and maintenance of the supported object. The flexible drive shaft 120 is connected between the drive tool and the threaded rod 100. The drive tool is actuated to rotationally drive the threaded rod 100, thereby moving the carriage 70 upwardly through the channel 36, into the elevated position shown in solid lines in FIG. 1. In the elevated position, the carriage locks 170 engage the carriage guides 76 to prevent vibration of the supported object. The coupling 182 of the cable is connected to a cooperating coupling adjacent the bottom 34 of the elongate pole 30 to connect the supported object to a remote device and/or power source. The flexible driveshaft 120 is removed, and cover plate(s) are installed over all access openings 124. The supported object is then used according to standard practice. For example, a supported surveillance camera obtains images from a monitored area surrounding the support pole 10, and sends signals to remote monitoring and/or recording devices. To service the supported object, the cover plate(s) are removed from access opening(s) 124, the cable coupling 182 is detached, the driveshaft 120 is coupled between a drive tool and the threaded rod, and the threaded rod is rotationally driven to lower the carriage 70. When servicing is complete, the supported object is raised back into the elevated position as described above.

It will be readily apparent to those of ordinary skill in the art that many additions, modifications and deletions can be made thereto without departing from the spirit and scope of the invention.

What is claimed is:

1. A support pole comprising:

an elongate pole having a first end and a second end, wherein said elongate pole defines a channel extending at least partway between the first and second ends;

a carriage translationally mounted to said pole;

at least one first banner post mounted between the first and second ends of said elongate pole; and a gasket sealing an opening to said channel.

2. The support pole of claim 1, further comprising drive means for translationally moving said carriage along at least a portion of said pole.

3. The support pole of claim 2, wherein said drive means comprises a threaded rod rotationally mounted within the channel of said pole.

4. The support pole of claim 1, further comprising a stabilizer frame within the elongate pole.

5. The support pole of claim 1, further comprising a cable having a first end carried by said carriage, a second end comprising a detachable coupling, and an intermediate section between said first and second ends.

6. The support pole of claim 5, further comprising a cable transport mechanism, said cable transport mechanism comprising at least one pulley and a return lanyard connected to said cable.

7. The support pole of claim 5, further comprising a return spring connected to said cable.

8. The support pole of claim 1, further comprising at least one carriage lock adjacent one end of the elongate pole for engagement with a cooperating portion of said carriage.

9. The support pole of claim 8, wherein each said carriage lock comprises a beveled, inclined surface.

10. The support pole of claim 9, wherein said carriage comprises at least one carriage guide having a beveled, inclined surface for cooperative engagement with the beveled, inclined surface of said carriage lock.

11. A support pole comprising:

an elongate pole having a first end and a second end;

a carriage translationally mounted to said pole;

at least one first banner post mounted between the first and second ends of said elongate pole;

at least one second banner post connected to said carriage; and at least one carriage lock adjacent one end of the elongate pole for engagement with a cooperating portion of said carriage, wherein each said carriage lock comprises a beveled, inclined surface.

12. The support pole of claim 11, wherein said carriage comprises at least one carriage guide having a beveled, inclined surface for cooperative engagement with the beveled, inclined surface of said carriage lock.

13. The support pole of claim 11, further comprising drive means for translationally moving said carriage along at least a portion of said pole.

14. The support pole of claim 13, wherein said drive means comprises a threaded rod rotationally mounted within said pole.

15. The support pole of claim 11, wherein said elongate pole defines a channel extending at least partway between the first and second ends, and further comprising a gasket sealing an opening to said channel.

16. The support pole of claim 11, further comprising a stabilizer frame within the elongate pole.

17. The support pole of claim 11, further comprising a cable having a first end carried by said carriage, a second end comprising a detachable coupling, and an intermediate section between said first and second ends.

18. The support pole of claim 17, further comprising a cable transport mechanism, said cable transport mechanism comprising at least one pulley and a return lanyard connected to said cable.

19. The support pole of claim 17, further comprising a return spring connected to said cable.

20. A support pole comprising:

an elongate pole having a first end and a second end;

a carriage translationally mounted to said pole;

a cable having first and second ends, the first end of said cable being carried by said carriage; and a cable transport mechanism for carrying said cable as the carriage moves along the elongate pole, wherein said cable transport mechanism comprises:

a first pulley proximal the first end of said pole;

a second pulley proximal the second end of said pole; and a return lanyard having one end connected to the first end of said cable and another end connected to the second end of said cable.

21. The support pole of claim 20, further comprising at least one first banner post mounted to said elongate pole between its first and second ends, and at least one second banner post connected to said carriage.

22. The support pole of claim 20, further comprising drive means for translationally moving said carriage along at least a portion of said pole.

23. The support pole of claim 22, wherein said drive means comprises a threaded rod rotationally mounted within said pole.

24. The support pole of claim 20, further comprising at least one carriage lock adjacent one end of the elongate pole for engagement with a cooperating portion of said carriage.

25. The support pole of claim 24, wherein each said carriage lock comprises a beveled, inclined surface.

26. The support pole of claim 25, wherein said carriage comprises at least one carriage guide having a beveled, inclined surface for cooperative engagement with the beveled, inclined surface of said carriage lock.

27. The support pole of claim 20, wherein said elongate pole defines a channel extending at least partway between the first and second ends, and further comprising a gasket sealing an opening to said channel.

28. The support pole of claim 20, further comprising a stabilizer frame within the elongate pole.

29. A support pole for raising and lowering a supported object between a lowered position and an elevated position, said support pole comprising:

an elongate pole having a top, a bottom, and a channel extending at least partly between said top and said bottom;

a threaded rod rotationally mounted within said channel;

a carriage in engagement with said threaded rod, whereby rotation of said rod imparts translational movement upon said carriage through said channel;

a cable having first and second ends, the first end of said cable being carried by said carriage;

a lanyard having one end connected to the first end of said cable and another end connected to the second end of said cable;

a first pulley carrying said cable; and a second pulley carrying said lanyard.

30. The support pole of claim 29, further comprising a first attachment point for a banner, located between the top and the bottom of said elongate pole; and a second attachment point for a banner, connected to said carriage.

* * * * *